US005415091A

United States Patent [19]

Junghans

[11] Patent Number: 5,415,091

[45] Date of Patent: May 16, 1995

[54] DEVICE FOR PREFILTERING DAMPENING WATER

[75] Inventor: Rudi Junghans, Wilhelmsfeld, Germany

[73] Assignee: Heidelberger Druckmaschine AG, Heidelberg, Germany

[21] Appl. No.: 115,936

[22] Filed: Sep. 1, 1993

[30] Foreign Application Priority Data

Sep. 2, 1992 [DE] Germany ..... 42 29 311.1

[51] Int. Cl.[6] ..... B41L 25/00

[52] U.S. Cl. ..... 101/147; 101/148

[58] Field of Search ..... 101/147, 148

[56] References Cited

U.S. PATENT DOCUMENTS 3,288,061 11/1966 Doyle ..... 101/210
3,949,668 4/1976 Smith ..... 101/148
4,574,695 3/1986 Ryan ..... 101/148
5,177,975 1/1993 Mertens ..... 62/64
5,181,467 1/1993 Takekoshi ..... 101/148
5,277,111 1/1994 Uribe et al. ..... 101/424

FOREIGN PATENT DOCUMENTS 9101888 6/1992 Germany .
1543513 4/1979 United Kingdom .

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

Device for prefiltering dampening medium in a printing press having at least one printing unit includes a prefilter housing, and a prefilter unit disposed in the housing, the prefilter housing being integrated into the printing unit of the printing press.

11 Claims, 3 Drawing Sheets

DEVICE FOR PREFILTERING DAMPENING WATER

This invention relates to a device for prefiltering dampening water or the like in a printing press with at least one printing unit.

To clean the dampening water of impurities, such as ink particles and paper fibers, a prefiltering device is provided in association with each printing unit of a printing press. This prefiltering device is located in a separate housing, which is conventionally located outside the printing press. Such separate devices not only give a negative impression when viewed, but also interfere with the work on the printing press.

It is accordingly an object of the invention to provide a device which eliminates these disadvantages of the state of the art.

With the foregoing and other objects in view, there is provided, in accordance with the invention, a device for prefiltering dampening medium in a printing press having at least one printing unit, comprising a prefilter housing, and a prefilter unit disposed in the housing, the prefilter housing being integrated into the printing unit of the printing press.

In accordance with another feature of the invention, at least part of a side wall of the prefilter housing is constructed as a door.

In accordance with a further feature of the invention, the housing door is simultaneously a door on an operating side of the printing unit. As a result of this construction, the prefilter unit is readily accessible from the operating side, for example. Filter mats in the prefilter unit can thus be replaced quite easily.

In accordance with an added feature of the invention, the prefilter housing has a frame for receiving the door therein, the frame being provided with elastic sealing material thereon. The sealing material can be formed of foam, for example.

In accordance with an additional feature of the invention, the door frame has fins disposed thereon, such as by welding, which are pressed into the elastic sealing material when the door is closed. As a result of these measures, isolation of the regions containing the dampening medium is assured. Corrosion caused by evaporation of dampening medium or volatilization of dampening-medium additives is prevented.

In accordance with yet another feature of the invention, a collection container for the dampening medium is located underneath the prefilter housing wherein the prefilter unit is disposed. This collection container or basin is of such dimensions that when the printing press is shut down, the dampening mixture is collected therein.

In accordance with still another feature of the invention, at least one dampening unit is included in the printing unit, and at least one duct has a hose disposed therein and extending from the dampening unit to the prefilter housing for returning dampening medium from the dampening unit to the prefilter housing. By laying the hose in a duct or hoses in respective ducts, the hoses do not interfere with any other adjusting elements of the printing unit. The ducts are also constructed so that no sharp bends or kinks occur in the hoses. Because deposits are likely to form at bends or kinks, the smooth layout of the hoses helps to prevent fouling or contamination, and in extreme cases even clogging of the hoses.

In accordance with yet a further feature of the invention, the hose or hoses extend through a side wall of the printing unit.

In accordance with yet an added feature of the invention, an upper side of the prefilter housing is formed as a basin.

The basin is constructed to catch oil. This combination of collecting basin and prefilter housing is particularly simple and economical.

In accordance with yet an additional feature of the invention, there are further included a main filter having a manifold line connected thereto, and means for conveying dampening medium from the prefilter unit to the manifold line and via the manifold line to the main filter. Thus, the dampening medium is conveyed by a line or lines from the prefilter units in respective printing units to a main filter. Such a main filter is disclosed, for example, in German Utility Model DE-U1 91 01 888.

In accordance with a concomitant feature of the invention, a level indicator is disposed in the prefilter. For example, the dampening-medium level is controlled by means of a float switch. Generally, an increase in the level of the dampening medium is an indication that the filter is becoming clogged as a result of impurities, and that there is a backup of dampening medium in the vicinity of the prefilter unit. Because overflowing dampening medium can also be cleaned briefly by the main filter, it is sufficient for the float switch to activate a warning signal. Because the main filter can take over briefly for the prefilter unit, the filter mats can be replaced while the printing press remains in operation.

Other features which are considered as characteristic for the invention are set forth in the appended claims.

Although the invention is illustrated and described herein as embodied in a device for prefiltering dampening water, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
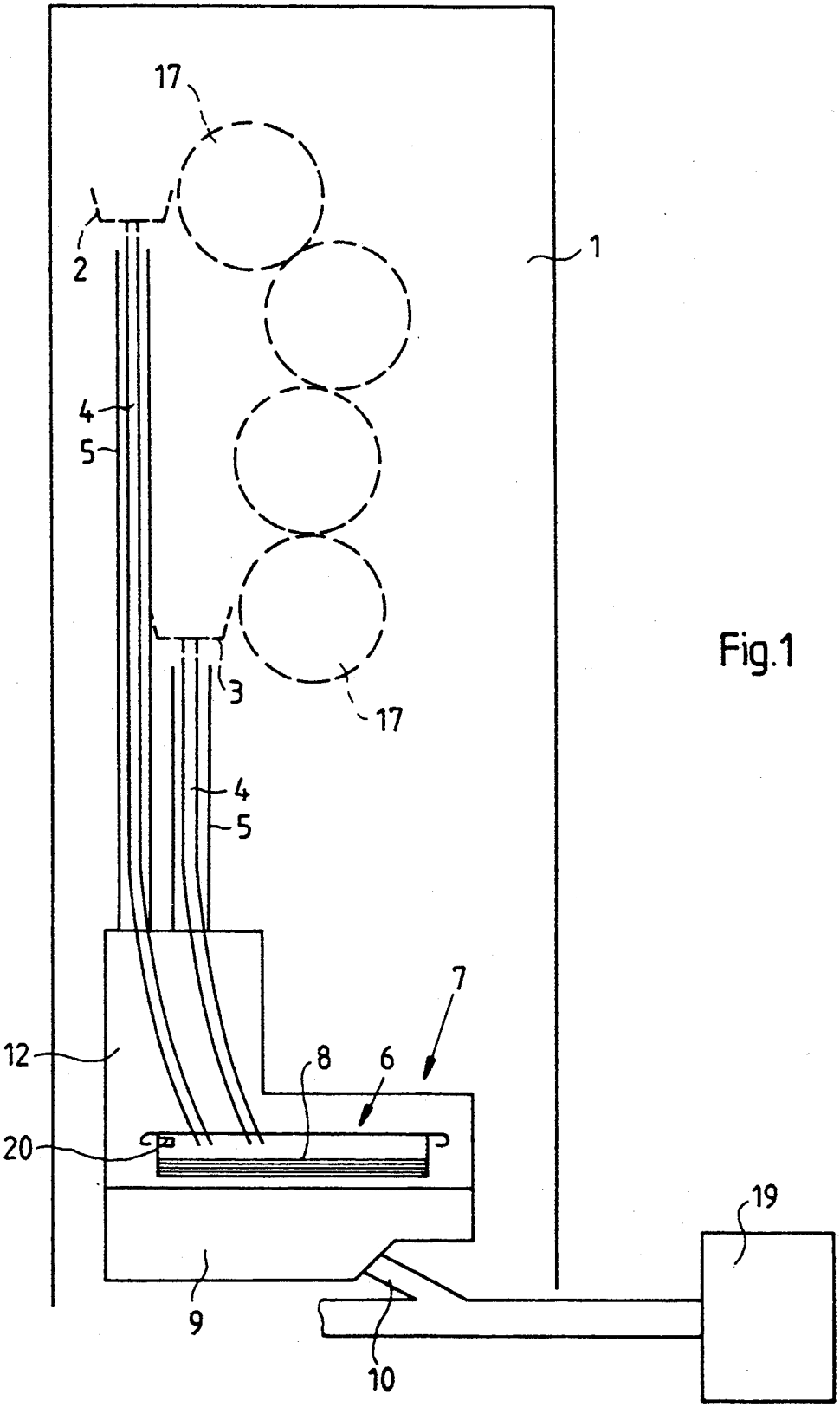
FIG. 1 is a diagrammatic side elevational view of a printing unit incorporating the prefiltering device according to the invention.

Referring now to the figures of the drawing and, first, particularly to FIG. 1 thereof, there is shown therein a printing unit 1 of an otherwise non-illustrated web-fed rotary printing press. The device for prefiltering dampening water in accordance with the invention is integrated into this printing unit 1.

An upper dampening unit 2 and a lower dampening unit 3 are associated with respective impression cylinders 17. A return flow of dampening water from dampening units 2 and 3 takes place via hoses 4 guided in channels or ducts 5. Via the hoses 4, dampening water which is to be cleaned reaches a prefilter unit 6 in which filter mats 8 are arranged. The prefilter unit 6 is located in a filter housing 7. This filter housing 7 is closed by a door 12 located on the operating side of the printing unit 1.

Underneath the prefilter unit 6 is a collecting vessel or container 9, which is at least large enough to hold the dampening mixture flowing out of the dampening units 2 and 3 and the prefilter unit 6 when the press has been stopped. The collection container 9 is connected to a main filter 19 by means of a collecting line or manifold 10.

In the prefilter unit 6, a level indicator 20, e.g. a float switch, is disposed which activates a warning indicator when a given level is exceeded.

Figure 2:
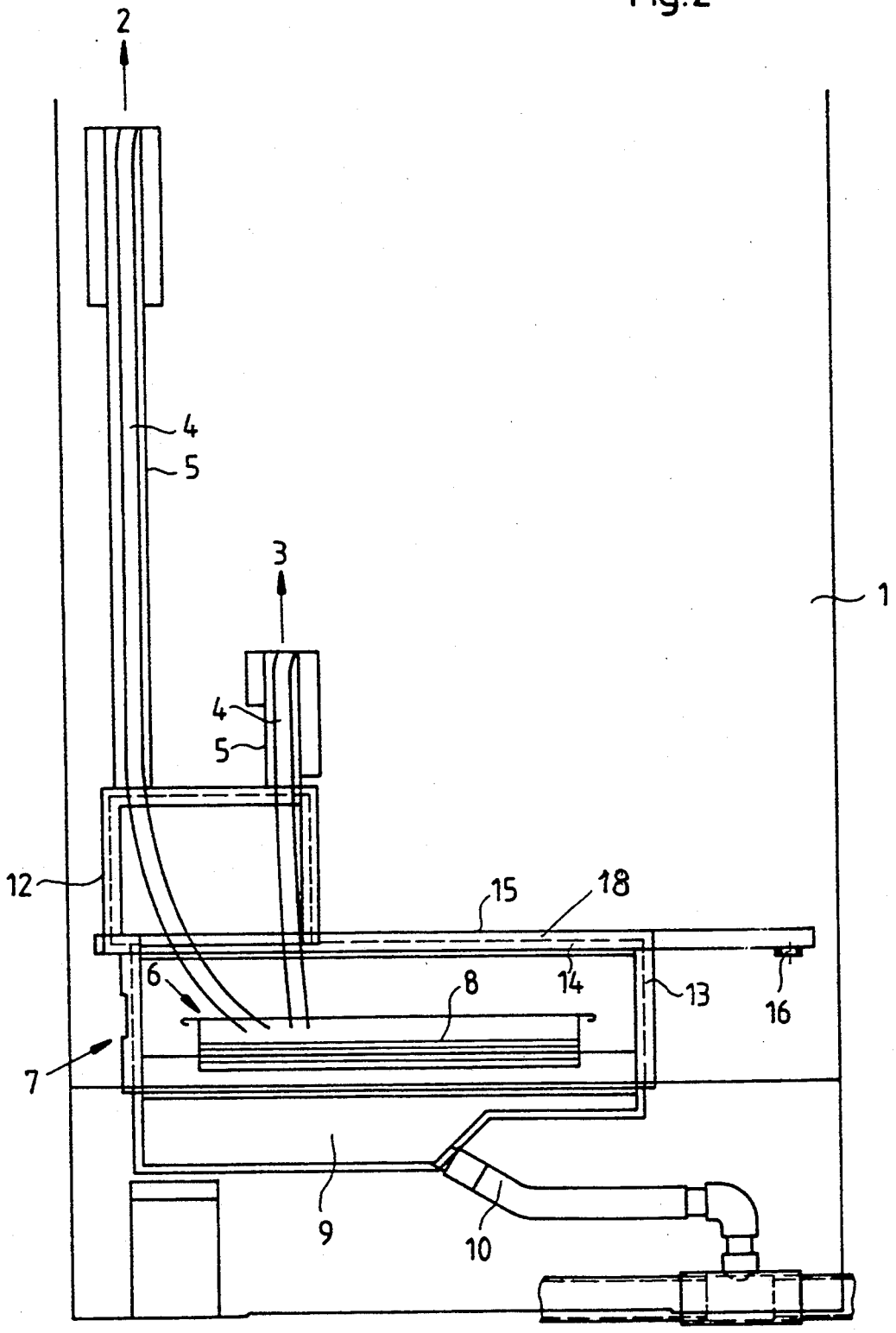
FIG. 2 is another diagrammatic view like that of FIG. 1 showing the prefiltering device according to the invention slightly enlarged and in greater detail.

FIG. 2 shows the device for prefiltering dampening water in accordance with the invention in a diagrammatic side elevational view. The device according to the invention is located in a lower region of the printing unit 1. The dampening water is transported from the upper and lower dampening units 2 and 3, respectively, via hoses 4 into the prefilter unit 6. The hoses 4 are laid out in ducts or channels 5.

The prefilter unit 6 in which the filter mats 8 are located is disposed in the filter housing 7. The collection vessel or container 9 is located underneath the prefilter unit 6. From the collection container 9, the dampening medium is transported by means of a line 10 to the main filter 19 (note FIG. 1).

The filter housing 7 for the prefilter unit 6 is closed by a door 12 which is simultaneously the door on the operating side of the printing unit 1. A frame of the prefilter housing 7, which holds the door 12, is provided with elastic sealing material 13. The elastic sealing material 13 may be foam, for example. To form a seal in the regions wherein dampening medium is being fed, strips or fins are additionally provided on the door frame and, when the door is closed, are pressed into the sealing material. An effective sealing of the regions wherein the dampening medium is fed is thereby achieved. Relatively problem-free access to the prefilter unit 6 becomes possible simply by opening the door 12 from the operating side, which significantly facilitates the replacement of the filter mats 8, for example.

The upper side 15 of the prefilter housing 7 is advantageously constructed as a basin or tub 18. Thus, the upper side 15 of the prefilter housing 7 is simultaneously able to catch oil dripping from the bearings of the central lubrication system. Because the upper side 15 of the prefilter housing 7 thus fulfills a double function, this construction of the inventive device is particularly economical. The oil is discharged from the basin 18 by means of a drain pipe 16.

Figure 3:
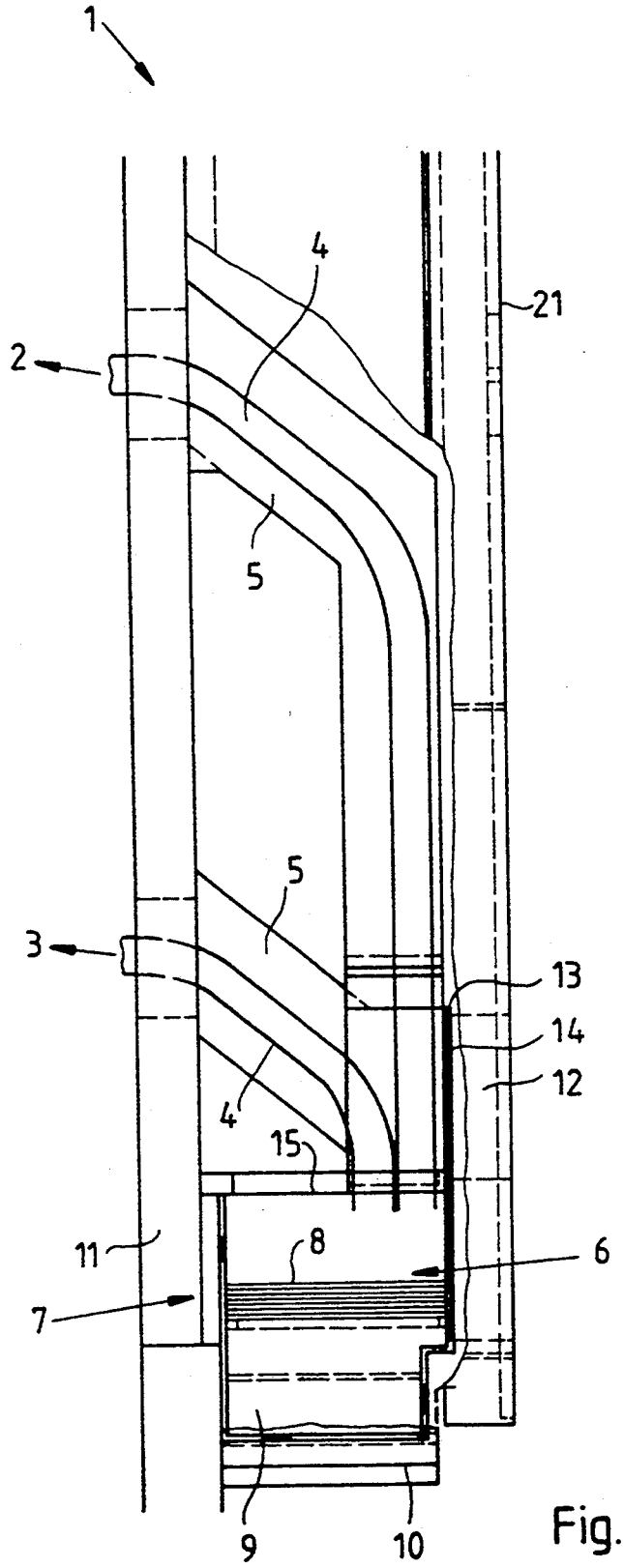
FIG. 3 is a diagrammatic view of the prefiltering device according to the invention, as seen from the left-hand side of FIG. 2.

FIG. 3 is a diagrammatic elevational view of the device for prefiltering the dampening water in accordance with the invention, as seen from the left-hand side of FIG. 2. The prefilter unit 6 is located in the upper region of the filter housing 7, and the collection container 9 is located in the lower region thereof. The regions feeding or distributing the dampening medium are partitioned or compartmentalized by sealing material 13 and by fins or strips 14 which are located on the inside of the door 12 and project into the sealing material 13.

The hoses 4 conducting the dampening medium extend through the side wall 11 of the printing unit 1, and then through ducts or channels 5, so that they do not interfere with any of the adjusting elements or moving parts of the printing unit 1.

In constructing the ducts or channels 5, care has been taken to lay out the hoses, as much as possible, without sharp bends and kinks, thereby preventing fouling and possibly even clogging of the hoses.

The foregoing is a description corresponding in substance to German Application P 42 29 311.1, dated Sep. 2, 1992, the International priority of which is being claimed for the instant application, and which is hereby made part of this application. Any material discrepancies between the foregoing specification and the aforementioned corresponding German application are to be resolved in favor of the latter.

I claim:

1. Device for prefiltering dampening medium in a printing press having at least one printing unit, the printing unit having an operating side thereof and a door on the operating side, comprising a prefilter housing with a side wall, and a prefilter unit disposed in said housing, said side wall of said prefilter housing being at least a part of the door on the operating side of the printing unit.

2. Device according to claim 1, wherein said prefilter housing has a frame for receiving said door therein, said frame being provided with elastic sealing material thereon.

3. Device according to claim 2, wherein said frame has fins disposed thereon which are pressed into said elastic sealing material when said door is closed.

4. Device according to claim 1, including a collection container for the dampening medium located underneath said prefilter housing wherein said prefilter unit is disposed.

5. Device according to claim 1, including at least one dampening unit in the printing unit, at least one duct having a hose disposed therein and extending from the dampening unit to said prefilter housing for returning dampening medium from the dampening unit to said prefilter housing.

6. Device according to claim 5, wherein said hose extends through a side wall of the printing unit.

7. Device according to claim 1, wherein an upper side of said prefilter housing has the shape of a tub.

8. Device according to claim 1, including a main filter having a manifold line connected thereto, and means for conveying dampening medium from said prefilter unit to said manifold line and via said manifold line to said main filter.

9. Device according to claim 1, including a level indicator disposed in said prefilter.

10. Device for prefiltering dampening medium in a printing press having at least one printing unit, comprising a prefilter housing with a side wall, and a prefilter unit disposed in said housing, wherein at least part of the side wall of said prefilter housing is constructed as a door, and said prefilter housing having a frame for receiving said door therein, said frame being provided with elastic sealing material thereon.

11. Device according to claim 10, wherein said frame has fins disposed thereon which are pressed into said elastic sealing material when said door is closed.

* * * * *